US007544284B2

(12) United States Patent
Sanchez et al.

(10) Patent No.: US 7,544,284 B2
(45) Date of Patent: Jun. 9, 2009

(54) PROCESS FOR THE RECOVERY OF A HYDROGEN-RICH GAS AND A STABILIZED LIQUID

(75) Inventors: Eric Sanchez, Rueil Malmaison (FR); Béatrice Fischer, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 561 days.

(21) Appl. No.: 11/203,158

(22) Filed: Aug. 15, 2005

(65) Prior Publication Data

US 2006/0032787 A1 Feb. 16, 2006

(30) Foreign Application Priority Data

Aug. 13, 2004 (FR) ..... 04 08895

(51) Int. Cl.
*C10G 49/22* (2006.01)

(52) U.S. Cl. ..... 208/101; 208/100; 208/102

(58) Field of Classification Search ..... 208/46, 208/95, 100, 101, 102, 103, 104, 105, 308, 208/340, 341, 342, 343, 344, 345, 346
See application file for complete search history.

(56) References Cited

U.S. PATENT DOCUMENTS 3,520,799 A * 7/1970 Forbes ..... 208/101
3,666,658 A 5/1972 Hallman
4,333,819 A * 6/1982 Scheifele, Jr. ..... 208/101
4,374,726 A * 2/1983 Schmelzer et al. ..... 208/101

* cited by examiner

*Primary Examiner*—Glenn Caldarola
*Assistant Examiner*—Randy Boyer
(74) *Attorney, Agent, or Firm*—Millen, White, Zelano & Branigan

(57) ABSTRACT

Process for the treatment of a hydrocarbon mixture that comprises hydrogen, in which the mixture is separated at pressure P1 into a liquid L1 and a gas G1 that is compressed under a pressure P2>2×P1; compressed gas G1 is then brought into contact with at least a portion of L1 so as to recover a liquid L2 and a hydrogen-rich gas G2; at least one stabilized liquid and a light liquid stream LL comprising primarily LPG, of which at least a portion is reduced in pressure and mixed with gas G1 to facilitate its compression, are recovered by fractionation from G1** and/or from L2**. The invention also relates to a process for reforming hydrocarbons with such an effluent treatment.

17 Claims, 3 Drawing Sheets

PROCESS FOR THE RECOVERY OF A HYDROGEN-RICH GAS AND A STABILIZED LIQUID

FIELD OF THE INVENTION

The invention relates to the field of treatments of effluents from conversion units or petroleum or petrochemical refining units, whose effluents comprise both hydrogen and hydrocarbons, such as: methane, ethane, propane, butane, hydrocarbon fractions that have 5 to 11 carbon atoms (designated by $C_5$-$C_{11}$), and optionally heavier hydrocarbons such as hydrocarbons that have between 12 and 30 carbon atoms ($C_{12}$-$C_{30}$) and even more, often in a small quantity.

It can involve in particular boiling treatment of a catalytic reforming effluent or fraction aromatization effluent in the field of gasoline (essentially having 6 to 11 carbon atoms), making it possible to recover an aromatic reformate, a hydrogen-rich gas, and a liquefied petroleum gas (product that we will designate by "LPG," essentially comprising hydrocarbons with three or four carbon atoms: propane and/or propylene and/or butane and/or butenes and/or butadiene, as well as their mixtures). In the case of catalytic reforming, the LPG essentially consists of saturated compounds: propane and butane.

The invention can also be applied to dehydrogenation effluents, for example butane, or pentane or higher hydrocarbons, for example fractions that essentially comprise hydrocarbons that have 10 to 14 carbon atoms, whose olefins are used downstream for the production of linear alkylbenzenes (commonly called LAB). The process according to the invention can also be applied to hydrotreatment (and/or hydrodesulfurization and/or hydrodemetallization and/or total or selective hydrogenation) of all hydrocarbon fractions such as naphtha, gasoline, kerosene, light gas oil, heavy gas oil, vacuum distillate, and vacuum residue. In a more general way, it can be applied to any effluent that comprises hydrogen as well as light hydrocarbons (methane and/or ethane), LPG, as well as heavier hydrocarbons.

The invention will be described below, in a nonlimiting way, essentially within the framework of catalytic reforming.

PRIOR ART

It is known to treat a hydrocarbon feedstock that comprises hydrogen so as to recover a hydrogen-rich gas, LPG, and a stabilized hydrocarbon liquid, for example, in the case of treatment of catalytic reforming effluents.

Typically three objectives are sought beyond the production of stabilized reformate, fuel base with a high octane number:

a) To separate a high-purity hydrogen gas that can be used for various refining processes;

b) To separate the LPG fractions of relatively high added value from lighter hydrocarbon fractions (methane, ethane), c) To isolate the largest quantity possible of these light fractions, which are separated from the hydrogen-rich gas, on the one hand, and from LPG, on the other hand, to send them to the fuel gas network.

The goal is then to maximize the recovery of LPG and to reduce the losses of LPG allowed in the fuel gas.

The treated effluents often comprise excess gas that is produced by chemical reaction, and in this case, it is sought to recover this high-purity hydrogen to facilitate its use downstream. In other cases, they comprise a purging gas that is used, even when the chemical reaction is hydrogen-intensive, to keep adequate purity in hydrogen in the reaction loop, by making possible an evacuation of light hydrocarbons: methane, ethane, propane, and even butane, which tend to accumulate in this reaction loop.

U.S. Pat. No. 5,965,014 describes a method for recovering liquefiable hydrocarbons from a hydrogen-rich gas stream and a stream that contains liquid hydrocarbons, by cooling this gas stream, this liquid stream, and by absorption of liquefiable hydrocarbons by using the thus cooled liquid stream. In this method, the gas stream and the stream that contains liquid hydrocarbons are cooled in the same cooling unit and brought into contact in a counter-current absorption column. A gas that is rich in hydrogen and that has a reduced quantity of liquid hydrocarbons is recovered at the top of the absorption column.

One of the problems posed by this type of process is the necessity for using a compressor that makes possible the compression and the circulation of the gas stream. The absorption, however, is all the more effective as the pressure becomes higher. This compressor is therefore generally operated with a differential pressure and a compression level that are high. This makes it possible to reach the desired pressure level for the hydrogen-rich gas while compensating for the counterpressure due to losses of pressure generated by the cooling means and other intermediate equipment. Furthermore, in the case of large-capacity reforming units, this compressor is generally of the centrifugal type.

Taking into account high capacities of certain reforming units and the cost of this type of compressor, there is a need for one skilled in the art to reduce the complexity and/or the number of stages of the compressor, in particular when the latter is of centrifugal type.

DESCRIPTION OF THE INVENTION

The invention proposes a process for the treatment of an effluent of a hydrocarbon conversion reaction, comprising a hydrocarbon liquid phase and a hydrogen-rich gaseous phase, in which:

a) the feedstock is separated into a liquid L1 and a gas G1, under a pressure P1, b) at least a portion G1* of G1 is compressed under a pressure P2>2×P1 to obtain a gas stream G1 that is then brought into contact at a temperature that is less than or equal to 20° C. with at least a portion of L1, optionally after partial condensation and/or a first contact with an absorbent liquid (able in a mixture to absorb LPG from G1****) so as to recover a liquid L2 and a hydrogen-rich gas G2, c) L2 is then fractionated to obtain at least: a stabilized liquid L4***a* that is essentially free of LPG and lighter products, a liquid stream L4*b* that primarily comprises LPG, and a low-hydrogen fuel gas, and in which a light liquid stream LL that primarily comprises LPG, which after pressure reduction and at least partial re-evaporation is mixed with gas G1* to increase its molecular weight before at least its final compression up to pressure P2, is recovered by fractionation of G1 and/or from L4***b*.

Thus, the invention carries out a treatment that comprises the production and the separation of an LPG-rich light liquid stream LL (typically comprising more than 30% by weight of LPG, preferably more than 50% by weight and very preferably more than 60% by weight, for example between 60 and 99% by weight), then the recycling of this stream and its mixing with the gas to be compressed. It was found that the latter led to an increase of the molecular weight of the gas and to an increased capacity of this gas to be compressed, in particular to a reduction in the number of compression stages.

According to the invention, G2 is rich in hydrogen if it contains more than 75 mol % of hydrogen, and the fuel gas is low in hydrogen if it contains less than 30 mol % of hydrogen; a liquid will be considered stabilized if it is obtained from a distillation column that produces LPG at the top and from which the initially contained LPG is essentially removed.

According to a preferred embodiment of the process according to the invention, stream LL is reduced in pressure, then frigories on the LL that is reduced in pressure are recovered by heat exchange with a stream C that is obtained from L1 and/or L2 and/or G1, before mixing it with G1***. This variant makes it possible to recover frigories in stream LL, frigories that are very useful for the fractionation of effluents carried out by the process. The effect of improving the compressibility of the gas is then doubled by an internal-loop cooling effect.

The heat exchange is preferably carried out in an exchanger (referenced 37 in the figures described below) with multiple passages and comprises:

- a first passage into exchanger (37) for cooling stream C,
- a second passage into exchanger (37) for cooling stream LL before pressure reduction,
- a third passage into exchanger (37) for the partial or total evaporation of the LL stream that is precooled, then reduced in pressure, with a transfer of frigories.

During the first passage, stream LL is typically cooled between −10° C. and +25° C., preferably between −5° C. and +20° C., and very preferably between 0° C. and +15° C. This makes it possible to limit the auto-evaporation by reducing the pressure of the LL and to maximize the subsequent restoration of frigories.

It is also possible to add a fraction of the recompressed gas G1** to stream LL that is reduced in pressure before the transfer of frigories to promote its evaporation. This also makes it possible to obtain, after reducing the pressure of the LL, a very low temperature, typically less than −20° C., often −25 and even −30° C., and thus to make possible the production and the transfer of frigories at a very low temperature level. It is possible to add, for example, a quantity of gas that corresponds to 0.5 to 15% by weight of LL.

These frigories at very low temperature are typically used to cool stream C to a temperature of between −30 to 5° C., preferably between −25 to 0° C., more preferably from −20 to −5° C.

Stream C is one of the streams that it is useful to cool to allow a good separation of effluents. It can involve gas G1 itself, a non-stabilized liquid L1 or L2, and/or a mixture and/or a fraction of these streams. Stream C is preferably a liquid stream that is obtained from L1 and/or L2, which after cooling is brought into contact, preferably in counter-current, with G1**, preferably pre-cooled. The low-temperature frigories that are recovered during the reheating of LL after the pressure is reduced are thus transferred to an LPG absorption liquid for the purification of gas G2 and the increase of its hydrogen content. The more suitable streams C according to the invention are L1, on the one hand, and, on the other hand, the minor fractions of L1, for example 3 to 50% by weight of L1, preferably 5 to 40% by weight of L1, and very preferably 10 to 35% by weight of L1. The use as stream C of minor fractions of L1 makes it possible, for a given quantity of available frigories, to cool C to a lower temperature and to obtain a better purity of hydrogen for G2. The balance of L1, or at least a portion of the balance of L1, can be mixed and/or precooled in a mixture, at a relatively higher temperature, for example between +10 and +30° C., with gas G1**, or obtained from G1** after precooling and partial condensation of G1****, to carry out a first absorption of LPG, methane, and ethane, and to produce the gas that is subjected to the final absorption, typically by stream C that is cooled to a low temperature.

Very preferably, C is brought into contact in counter-current with precooled G1 (relative to its temperature at the outlet of the compressor) in an absorption column for the production of the hydrogen-rich gas G2. The pre-cooling of G1** can be carried out up to a temperature such as one included between 20 and 50° C., for example by heat exchange with water. Preferably, a more intense pre-cooling will be carried out, for example between −5° C. and +20° C., and preferably between 0 and +15° C., for example thanks to a cooling group. It is thus possible to use frigories at a moderate heat level and to keep the frigories at a low heat level with use of stream LL that is reduced in pressure. Typically, C is cooled (thanks to LL) to a temperature that is low enough so that the recovered hydrogen-rich gas effluent G2** has a hydrogen content of more than about 90 mol %, preferably more than about 95 mol %, and more preferably more than about 97 mol %.

The invention also proposes a hydrocarbon reforming process with reforming effluent treatment according to any of the above-mentioned variants and technical arrangements, for the production of a stabilized reformate L4*a*, an LPG stream L4*b*, and a gas G2 that has a hydrogen content of more than about 90 mol %.

Thus, the invention makes it possible to facilitate the compression of the gas G1*, typically to reduce the size and/or the number of compression stages. It therefore responds to the need of one skilled in the art to reduce the size and/or the complexity of a normally costly piece of equipment to draw from it an economic advantage.

In a surprising way, the process according to the invention also makes it possible to produce frigories typically at a low temperature and to use these frigories to increase the hydrogen content of the recovered hydrogen-rich gas effluent G2.

DESCRIPTION OF THE FIGURES:

For a better understanding, three embodiments of the process of the invention are illustrated in FIGS. 1, 2 and 3. These embodiments are provided by way of example and do not exhibit any limiting nature. These illustrations of the process of the invention do not comprise all of the components necessary for its use. Only the components that are necessary for understanding the invention are shown there, whereby one skilled in the art is able to complete this representation for implementing the invention.

In the process of FIG. 1, an overall hydrocarbon catalytic reforming effluent, obtained from the conversion zone of a catalytic reforming unit, is cooled to a temperature that is close to ambient temperature, for example between 30 and 60° C., then fed via a pipe 1 into a first gas/liquid separator 2, or "cold" (low-pressure) separator, for example under a pressure P1 of between 0.2 and 0.5 MPa. At the outlet of this separator, the reforming effluent is divided into a gas stream G1 that circulates in a pipe 3 and a liquid stream L1 that circulates in a pipe 4.

Figure 1:
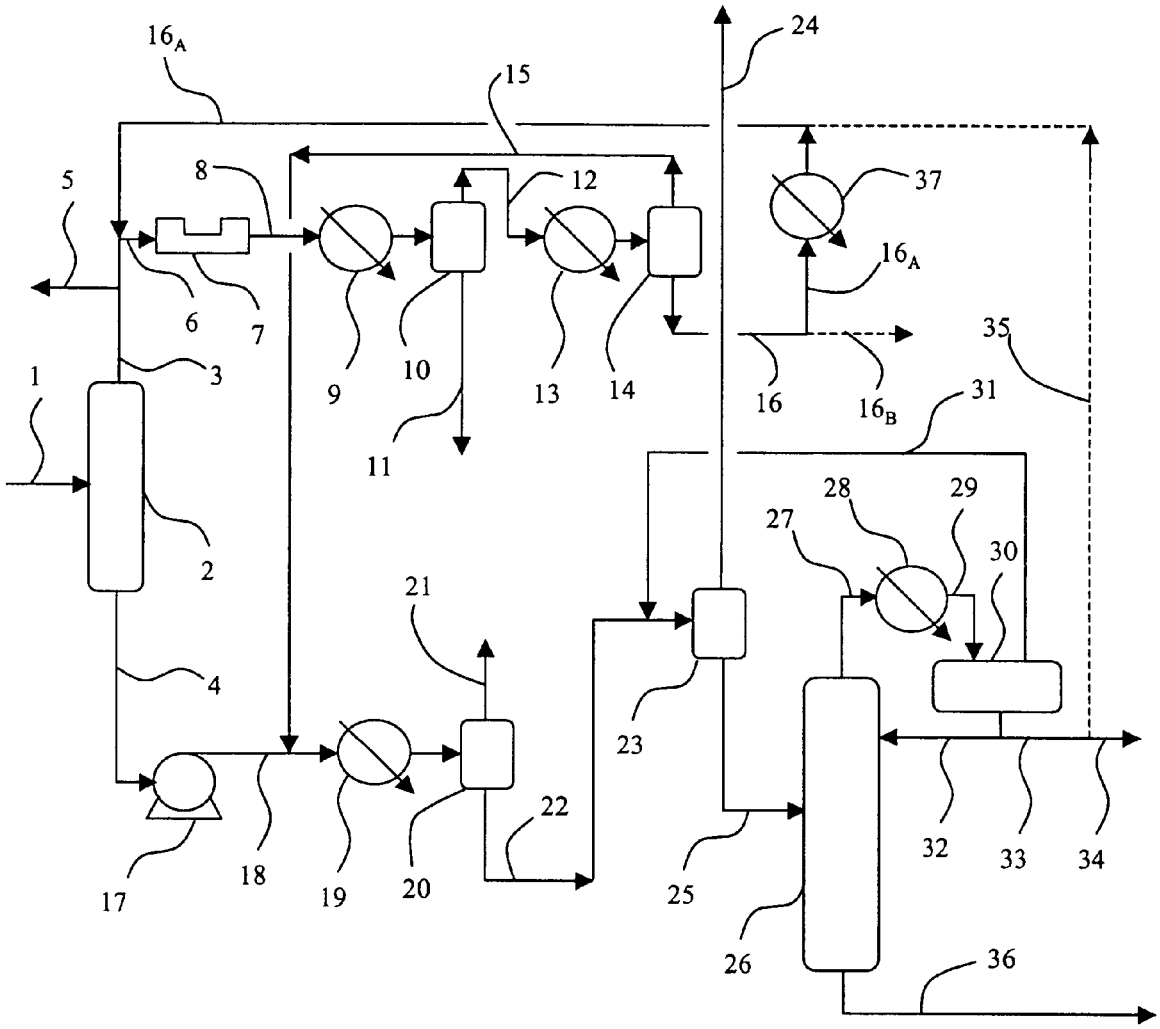

A portion of G1 (typically the primary portion) is recycled to the chemical conversion zone (reforming) via pipe 5. Residual gas stream G1* that circulates in pipe 3, which contains in particular hydrogen that is produced by reforming, is mixed with liquefied petroleum gas that is generally evaporated, transported via pipe $\mathbf{16}_A$ and that is obtained from the downstream portion of the process according to the invention. The mixture that consists of gas stream G1* and the liquefied petroleum gas is fed via a pipe 6 into a centrifugal-type compressor 7. The fact of adding liquefied petroleum gas to the gas stream makes it possible, in a way that is characteristic according to the invention, to increase the molecular weight of the gas and to reduce the polytrophic height of compressor 7, which makes it possible in particular to reduce the number of stages of the latter, in this case passing from three to two stages.

The liquid stream that exits from separator 2 via pipe 4 is an unstabilized reformate that is sent, via a pump 17 and a pipe 18, into a cooling means 19. This means can be any cooling means that is known to one skilled in the art, such as a cold box or a cryogenic exchanger, for example cooled by a cooling group.

At the outlet of compressor 7, gas stream G1, compressed at a pressure P2 of between, for example, 1.5 Mpa and 3.5 Mpa, is sent via a pipe 8 into a water exchanger 9 to be cooled there, for example to 15° C. The cooled, partially condensed stream is separated in a gas/liquid separator 10 into a stream of liquid condensates (composed primarily of light reformate) that exits via pipe 11 and a gas stream that exits via line 12. This gas stream is again cooled in an exchanger 13 to a cold temperature, in particular below the ambient temperature, for example between −15° C. and 0° C. A partial condensation results, and the stream is again separated in a gas/liquid separator 14 into a light liquid condensate stream LL (composed primarily of LPG) that exits via pipe 16 and a gas stream that exits via line 15**. A portion of the LPG-rich liquid stream is recycled via line $\mathbf{16}_A$ to increase the molecular weight of gas G1* and to facilitate its compression. This stream is typically reduced to low pressure (by a valve, not shown), then transfers its frigories during its reheating in a cryogenic exchanger 37. Reducing the pressure of the liquid produces an intense cooling, which makes it possible to recover frigories at low temperature (typically below −20° C.). It is also possible to add a little gas that is obtained from pipe 15 to facilitate the total re-evaporation of the liquid whose pressure is reduced.

A possible additional portion of the liquid that is obtained from separator 14 is recovered via line $\mathbf{16}_B$.

The gas that is obtained from separator 14 is recovered in line 15 and mixed with the unstabilized reformate that circulates in line 18. The mixture is cooled in exchanger 19 to a temperature typically included between −10° C. and 20° C., then separated in the gas/liquid separator (20) into a hydrogen-rich gas stream that is evacuated via line 21 and a liquid stream that is evacuated via line 22. This stream (of unstabilized reformate) is then mixed with a gas stream for recycling that is fed via line 31 (to collect the LPG that is contained in this gas stream for recycling), then separated in the gas/liquid separator 23 into a low-hydrogen gas-fuel stream that is sent to the fuel gas network via line 24, and a liquid stream that is evacuated via line 25. This liquid (which is still at this unstabilized reformate stage) is then stabilized by distillation in column 26. The stabilized reformate, from which LPG and lighter products have essentially been removed, exits at the bottom of column 26 and is evacuated via line 36. At the top of the column, the flow that exits via line 27 is partially condensed in exchanger 28, then reflux tank 30 is fed via line 29. A portion of the liquid that is produced (essentially LPG) is returned to the column as reflux via line 32. Another portion, corresponding to the production of LPG of the unit, is evacuated via line 34. Finally, a last portion is optionally recycled via line 35 to be mixed, according to the invention, with gas G1* that is to be compressed. The gas that is obtained from reflux tank 30 is partially or completely recycled via line 31. If the flow of this gas increases too much because of recycling, it is possible to send a portion of it to the fuel gas network via a line, not shown.

The liquid streams that circulate in lines 11, $\mathbf{16}_A$ are typically collected via lines, not shown, and sent into line 22 to be treated with the primary stabilized reformate stream.

This unit operates in the following way: Compressed gas G1 is cooled in two stages, with initial separation in tank 10 of the first condensed liquid, rich in compounds with 5 or more carbon atoms, next to produce an LPG-rich liquid stream LL in separator tank 14**, or comprising at least 30% by weight and typically at least 50% by weight of LPG. This stream is used according to the invention, after at least partial, and preferably total, pressure reduction and re-evaporation, to increase the weight of gas G1* before its compression, or before its final compression. The gas that exists from tank 14 also contains significant quantities of LPG as well as methane and ethane. To better collect these residual compounds and to increase the purity of the hydrogen produced, this gas is cooled in exchanger 19 after having been mixed with the unstabilized reformate stream. The reformate plays the role of an absorbent and makes it possible to collect a significant portion of the compounds that it is desired to separate from high-purity hydrogen, evacuated via line 21. The recovered reformate, rich in absorbed intermediate compounds, is brought into contact in tank 23 with an LPG-rich recycled gas to recover a portion of these LPG.

The recycling of LPG via line $\mathbf{16}_A$ makes it possible to significantly increase the weight of gas G1* that is to be compressed. This makes it possible, in particular in the case of a centrifugal compressor, to reduce the number of stages of the compressor, typically by 3 to 2 compression stages, which reduces its complexity and influences its cost and its reliability.

Another aspect of this LPG recycling relates to the cooling aspect: the LPG is reduced to the lower pressure of G1*; this brings about its intense cooling by evaporation, which can also be increased if LL is pre-cooled before being reduced in pressure, and/or a little gas that is sampled, for example, on line 15 is added to recycling LL. The LPG recycling thus can make it possible to recover frigories, in exchanger 37, and to carry out an internal cooling loop that produces cold at a very low temperature (for example less than −20° C.). This aspect can be used for a simplification of the outside cooling group, for which the cooling stage at a very low temperature can be eliminated.

Figure 2:
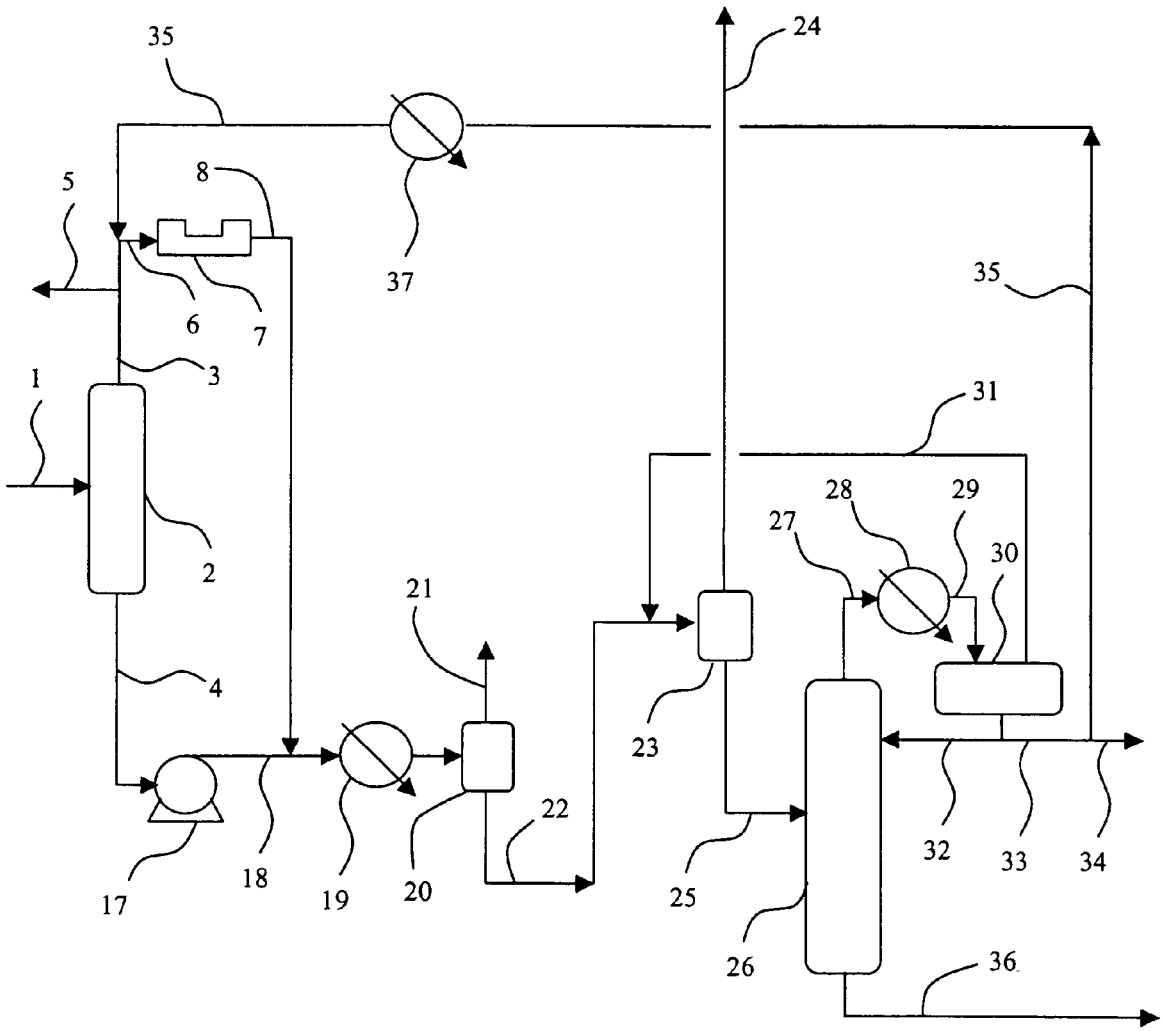

Reference is now made to FIG. 2, which shows a simplified version of the installation of FIG. 1: In this installation, gas G1 is not treated separately, before its contact at high pressure with the unstabilized reformate, but treated directly in a mixture with this reformate: by cooling in exchanger 19 then gas/liquid separation in tank 20**. This leads to a simplification of the diagram, but does not make it possible to isolate an LPG-rich stream that can be added to gas G1*. LPG stream LL that is required according to the invention is then produced more downstream, at the reflux tank of column 26 for stabilization of the reformate: the LPG stream (or LPG-rich stream) is recycled via line 35. The price for the simplification of the installation of FIG. 2 is the fact that column 26 for stabilization of the reformate is oversized since it must produce the additional LPG corresponding to stream LL.

Figure 3:
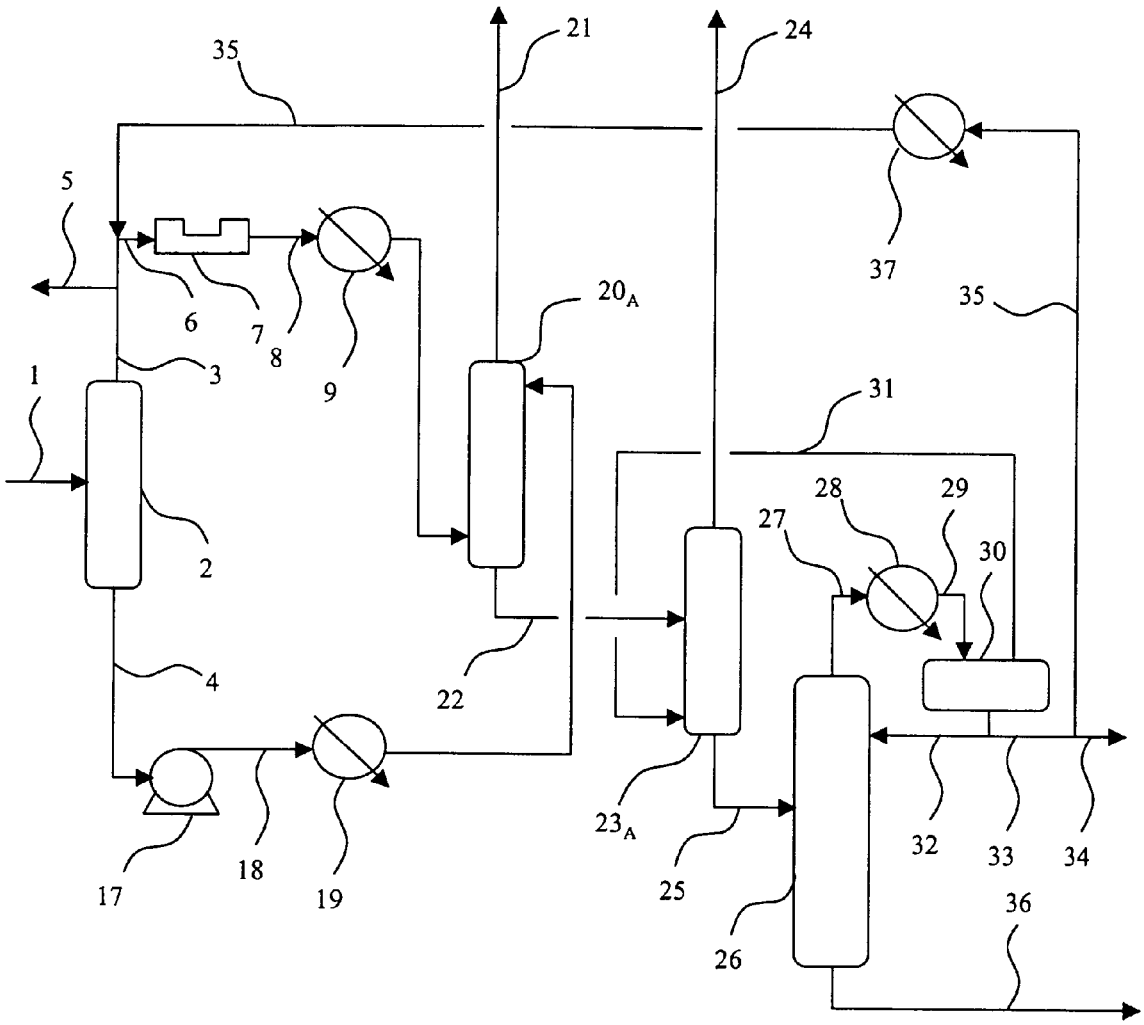

In the installation corresponding to FIG. 3, the compressed gas is also directly brought into contact with the reformate, but this contact is made in counter-current with the cooled reformate in a column $\mathbf{20}_A$ and not in a simple separator tank. Likewise, the reformate that is enriched with intermediate compounds and is recovered in line 22 is brought into contact with the recycled gas via line 31, but this contact is produced in counter-current in column $\mathbf{23}_A$ and not in a simple separator tank. These counter-current contacts are more effective for the collecting and recovery of LPG. Columns $\mathbf{20}_A$ and $\mathbf{23}_A$ typically can have between 1.5 and 10 theoretical stages, and preferably between 2 and 6 theoretical stages.

EXAMPLE

A) In a treatment of reforming effluents according to the prior art, a "cold" tank that operates under P1=3.2 MPa at a temperature of 40° C. is used. Gas G1* whose flow rate is 18876 kg/h and the molecular weight is MW=10 is compressed at pressure P2=28.7 MPa, which requires a 3-stage centrifugal compressor.

The compression conditions are provided in Table 1:

TABLE 1

| | Intake 1st Stage | Intake 2nd Stage | Intake 3rd Stage |
|---|---|---|---|
| Molecular Weight MW g/mol | 10 | 9.09 | 7.998 |
| Pressure MPa | 0.31 | 0.64 | 1.34 |
| Temperature ° C. | 40 | 40 | 40 |
| Density Kg: | 1.205 | 2.23 | 4.12 |
| Compressibility Factor Cp/Cv | 1.28 | 1.29 | 1.31 |
| Mass Rate kg/h | 18876 | 16981 | 14724 |

B) The process according to the invention is now used according to the diagram of FIG. 3. 6.5t/h of LPG recovered via line 35, which is mixed with G1, is added to the gas that is to be compressed. The simulation of the compressor under these conditions shows that it then is possible to use a 2-stage compressor, with the conditions given in Table 2:

TABLE 2

| | Intake 1st Stage | Intake 2nd Stage |
|---|---|---|
| Molecular Weight MW g/mol | 12.55 | 11.04 |
| Pressure MPa | 0.31 | 0.93 |
| Temperature ° C. | 40 | 40 |
| Density Kg: | 1.52 | 3.96 |
| Compressibility Factor Cp/Cv | 1.25 | 1.27 |
| Mass Rate kg/h | 25360 | 21853 |

The invention claimed is:

1. A process for the treatment of an effluent of a hydrocarbon conversion reaction, comprising a hydrocarbon liquid phase and a hydrogen-rich gaseous phase, in which:

a) the effluent is separated into a liquid L1 and a gas G1, under a pressure P1, b) at least a portion G1* of G1 is compressed under a pressure P2>2×P1 to obtain a gas stream G1 that, after a partial condensation thereof or after a first contact with an absorbent liquid, is then brought into contact at a temperature that is less than or equal to 20° C. with at least a portion of L1, so as to recover a liquid L2 and a hydrogen-rich gas G2, c) L2 is then fractionated to obtain at least: a stabilized liquid L4***a* that is essentially free of LPG and lighter products, a liquid stream L4*b* that primarily comprises LPG, and a low-hydrogen fuel gas, and in which a light liquid stream LL that primarily comprises LPG, which after pressure reduction and at least partial re-evaporation, is mixed with gas G1* to increase its molecular weight before at least its final compression up to pressure P2, is recovered by fractionation of G1 and/or from L4***b*.

2. A process according to claim 1, in which the pressure of stream LL is reduced, then the k cal of LL, whose pressure has been reduced are recovered by heat exchange with a stream C that is obtained from L1 and/or L2 and/or G1, before mixing it with G1***.

3. A process according to claim 2, in which said heat exchange is carried out in an exchanger (37) with multiple passages and comprises:

a first passage into exchanger (37) for cooling stream C, a second passage into exchanger (37) for cooling stream LL before pressure reduction, a third passage into exchanger (37) for the partial or total evaporation of the LL stream that is precooled, then reduced in pressure, with a transfer of k cal.

4. A process according to claim 2, in which a fraction of compressed gas G1** is added to stream LL whose pressure is reduced, before the transfer of k cal to promote its evaporation.

5. A process according to claim 2, in which stream C is cooled to a temperature of between −30 to 5° C.

6. A process according to claim 2, in which stream C is a liquid stream obtained from L1 and/or L2, which, after cooling, is brought into contact with G1**.

7. A process according to claim 6, in which stream C is brought into contact in counter-current with precooled G1, in an absorption column for the production of hydrogen-rich gas G2**.

8. A process according to claim 7, in which C is cooled to a temperature that is low enough so that the recovered hydrogen-rich gas effluent G2 has a hydrogen content of more than about 90 mol %.

9. A process according to claim 1 wherein said hydrocarbon conversion reaction comprises reforming effluents, and conducting said reforming so as to produce a stabilized reformate L4*a*, an LPG stream L4*b*, and a gas G2 that has a hydrogen content of more than about 90 mol %.

10. A process according to claim 5 wherein stream C is cooled to a temperature of between −25 to 0° C.

11. A process according to claim 5 wherein stream C is cooled to a temperature of between −20 to −5° C.

12. A process according to claim 6 wherein stream C, obtained from L1 and/or L2, which after cooling, is contacted counter-currently with G1**.

13. A process according to claim 6 wherein G1** is precooled prior to being contacted with said liquid stream.

14. A process according to claim 8 wherein said hydrogen-rich gas effluent G2 has a hydrogen content of more than 95 mol %.

15. A process according to claim 8 wherein said hydrogen-rich gas effluent G2 has a hydrogen content of more than 97 mol %.

16. A process for the treatment of an effluent of a hydrocarbon conversion reaction, comprising a hydrocarbon liquid phase and a hydrogen-rich gaseous phase, in which:

a) the effluent is separated into a liquid L1 and a gas G1, under a pressure P1, b) at least a portion G1* of G1 is compressed under a pressure P2>2×P1 to obtain a gas stream G1, after a partial condensation thereof, is then brought into contact at a temperature that is less than or equal to 20° C. with at least a portion of L1 so as to recover a liquid L2 and a hydrogen-rich gas, c) L2 is then fractionated to obtain at least: a stabilized liquid L4***a* that is essentially free of LPG and lighter products, a liquid stream L4*b* that primarily comprises LPG, and a low-hydrogen fuel gas, and in which a light liquid stream LL that primarily comprises LPG, which after pressure reduction and at least partial re-evaporation, is mixed with gas G1* to increase its molecular weight before at least its final compression up to pressure P2, is recovered by fractionation of G1 and/or from L4***b*.

17. A process for the treatment of an effluent of a hydrocarbon conversion reaction, comprising a hydrocarbon liquid phase and a hydrogen-rich gaseous phase, in which:

a) the effluent is separated into a liquid L1 and a gas G1, under a pressure P1, b) at least a portion G1* of G1 is compressed under a pressure P2>2×P1 to obtain a gas stream G1, after first contact with an absorbent liquid, is then brought into contact at a temperature that is less than or equal to 20° C. with at least a portion of L1, so as to recover a liquid L2 and a hydrogen-rich gas G2, c) L2 is then fractionated to obtain at least: a stabilized liquid L4***a* that is essentially free of LPG and lighter products, a liquid stream L4*b* that primarily comprises LPG, and a low-hydrogen fuel gas, and in which a light liquid stream LL that primarily comprises LPG, which after pressure reduction and at least partial re-evaporation, is mixed with gas G1* to increase its molecular weight before at least its final compression up to pressure P2, is recovered by fractionation of G1 and/or from L4***b*.

* * * * *

UNITED STATES PATENT AND TRADEMARK OFFICE

CERTIFICATE OF CORRECTION

PATENT NO. : 7,544,284 B2
APPLICATION NO. : 11/203158
DATED : June 9, 2009
INVENTOR(S) : Sanchez et al.

It is certified that error appears in the above-identified patent and that said Letters Patent is hereby corrected as shown below:

Column 7, line 53 reads:
"a) effluent is separated into a liquid L1 and a gas G1," should read: --a) feedstock is separated into a liquid L1 and a gas G1,--

Column 8, line 60 reads:
"a) effluent is separated into a liquid L1 and a gas G1," should read: --a) feedstock is separated into a liquid L1 and a gas G1,--

Column 9, line 14 reads:
"a) effluent is separated into a liquid L1 and a gas G1," should read: --a) feedstock is separated into a liquid L1 and a gas G1,--

Signed and Sealed this

Eighteenth Day of May, 2010

David J. Kappos

David J. Kappos
*Director of the United States Patent and Trademark Office*